United States Patent [19]

Avramidis

[11] Patent Number: 4,961,689

[45] **Date of Patent: * Oct. 9, 1990**

[54] POSITIVE DISPLACEMENT VACUUM PUMPS

[76] Inventor: Anestis S. Avramidis, 1605 W. St. Andrews, Midland, Mich. 48640

[ * ] Notice: The portion of the term of this patent subsequent to May 23, 2006 has been disclaimed.

[21] Appl. No.: 373,185

[22] Filed: Jun. 28, 1989

Related U.S. Application Data

[63] Continuation-in-part of Ser. No. 311,086, Feb. 15, 1989, which is a continuation-in-part of Ser. No. 78,794, Jul. 27, 1987, Pat. No. 4,832,577.

[51] Int. Cl.[5] ..... F04F 1/06

[52] U.S. Cl. ..... 417/118; 417/478

[58] Field of Search ..... 417/118, 172, 474, 478; 166/187

[56] References Cited

U.S. PATENT DOCUMENTS

| | | | |
|---|---|---|---|
| 3,015,280 | 1/1962 | King | 166/187 |
| 4,076,467 | 2/1978 | Persson | 417/478 |
| 4,489,779 | 12/1984 | Dickinson | 166/64 |
| 4,585,060 | 4/1986 | Bernardin | 166/64 |
| 4,593,760 | 6/1986 | Visser et al. | 166/267 |
| 4,630,691 | 12/1986 | Hooper | 166/187 |
| 4,660,639 | 4/1987 | Visser et al. | 166/267 |
| 4,790,376 | 12/1988 | Weeks | 417/172 X |
| 4,802,829 | 2/1980 | Miller | 417/118 |
| 4,832,577 | 5/1989 | Avramidis | 417/172 |
| 4,886,432 | 12/1989 | Kimberlin | 417/478 |

*Primary Examiner*—Leonard E. Smith
*Assistant Examiner*—Robert N. Blackmon

[57] ABSTRACT

Well pumping system that uses pressurized air as power fluid and operates simultaneously as a positive displacement pump and as a gas lift pump, to pump well fluids intermitently; and also may be used in combination with fluid actuated pumping devices to pump well fluids continuously, extracting them by suction from the pores of a geologic formation through the screen of a monitoring well, as often is required for remediation purposes in hazardous wastes projects, or soil stabilization purposes in foundation engineering projects. Solid particles in the well fluids are filtered prior to entering the pumping system. Well fluids are separated from the pressurized air by passing the well fluids-pressurized air mixture through separators upon discharge.

6 Claims, 8 Drawing Sheets

POSITIVE DISPLACEMENT VACUUM PUMPS

This application is a continuation in part of copending application Ser. No. 07/311,086, filed Feb. 15, 1989, for a "Vacuum Pump and Automatic Inflating Packers". Application Ser. No. 07/311,086 is a continuation in part of application Ser. No. 07/078,794, filed July 27, 1987, now U.S. Pat. No. 4,832,577, issued May 23, 1989.

BACKGROUND OF THE INVENTION

This invention relates to a well pumping system that uses pressurized air and operates simultaneously as a positive displacement pump and as a gas lift pump, to pump well fluids intermitently; and may also be used in combination with other pumping devices such as those disclosed in the copending application Ser. No. 07/311,086, filed Feb. 15, 1989, and in U.S. Pat. No. 4,832,577 issued on May 23, 1989, to pump well fluids continuously, extracting them by suction from the pores of a geologic formation.

In various Civil-Environmental Engineering projects wherein assessment of the ground water quality is to be made, it becomes necessary to collect ground water samples for subsequent chemical analysis. In common practice, ground water samples representing ground water in the pores of a geologic formation are collected from monitoring wells installed in the particular formation. The quality of the ground water samples however, may greately be affected by the presence of stagnant well fluids in the monitoring well. To assure collection of high quality ground water samples, it is required that stagnant well fluids be purged (removed) entirely or partially from the monitoring well prior to sample collection. Depending on the hydrogeologic characteristics of the geologic formation, well purging may become possible by pumping the well dry, or by pumping well fluids equivalent to a specified number of volumes of the stagnant well fluids. Various types of methods/devices are available for purging monitoring wells, for example: air lifting, hand bailers, and bladder pumps. U.S. Pat. Nos. 4,585,060 and 4,489,779 describe in detail a typical bladder pump. Among the disadvantages of all available methods/devices however are, the introduction of undesirable disturbances in the hydrogeologic regime around the well screen, their low pumping rate associated particularly with deep monitoring wells, and their high initial cost.

In similar projects, it is often necessary to extract by suction the fluids from the pores of the geologic formation for site remediation purposes, as required in spills of toxic substances in soils; and for soil stabilization purposes, as often required in foundation engineering problems The existing art, U S. Pat. No. 4,660,639, and U.S.-Pat. No. 4,593,760, employes a suction source that consists of a vacuum pump or an exhaust fan located at the ground surface away from the well screen. Usually, a single suction source is used at a central location connected to the heads of many extraction wells through an extensive piping network which may be susceptible to leaks. Under these conditions, an effective operation for extracting fluids by suction requires air flow control, which in turn may require balancing to assure proper suction distribution to each leg of the network, using a series of air flow meters and regulators. Additionally, if the extracted fluids are ignitable, as often is the case with petroleum product spills, the vacuum pumps must employ explosion-proof motors and nonsparking wheels rendering thus the extraction systems of the existing art expensive.

Therefore, the purpose of the present invention is to provide a pumping system that among its other uses may be used for more efficient and cost effective monitoring well purging, sampling, and extraction of fluids by suction from the pores of a geologic formation.

BRIEF SUMMARY OF THE INVENTION

The well pumping system disclosed herein, employes a coaxial hose connected to a fluid actuated pumping device. Copending application Ser. No. 311,086, filed Feb. 15, 1989, and U.S. Pat. Nos. 4,832,577, 4,585,060, and 4,489,779 describe various forms of such fluid actuated pumping devices. The coaxial hose consists of a relatively rigid inner tubing positioned inside a bladder type outer hose.

As the pumping system is submerged into the well fluids of a well, well fluids occupy all available space inside and outside the pumping system below the well fluids level in the well. During operation of the pumping system of the present invention, power fluids are supplied in the annular space between the outer bladder type hose, and the inner rigid tubing of the coaxial hose. The supplied power fluids simultaneously: force all well fluids to be evacuated quickly through the inner tubing of the coaxial hose; inflate the outer bladder type hose of the coaxial hose to engage the inner surface of the well casing forming thus a seal; and activate the pumping device which, as described in the copending application No. 07/311,086, filed on Feb. 15, 1989, and U.S. Pat. No. 4,832,577, creates suction at its inlet in the well space below the aformentioned seal. Consequently, the created suction is transmitted through the screen of the monitoring well to the pores of the geologic formation, where it extracts formation fluids.

Among the objects of the present invention are the provision of a low cost well pumping system that uses pressurized air as power fluid to quickly pump well fluids intermitently, or continuously; the provision of a well pumping system that uses a fluid actuated pumping device connected to a coaxial hose that supplies the power fluids to the pumping device and discharges the well fluids; the provision of a coaxial hose consisted of a bladder type outer hose, and an inner rigid tubing; the provision of a pumping system that induces no undesirable disturbances to the surrounding hydrogeologic regime; and the provision of a pumping system that exerts suction to, and extracts fluids from the pores of a geologic formation.

These and other objects and advantages of the invention will become more apparent as the description proceeds and when considered in conjunction with the accompanying drawings.

BRIEF DESCRIPTION OF THE DRAWINGS

FIG. 6 also shows the power fluids supply, and the discharge control valves.

DETAIL DESCRIPTION

Figure 1:
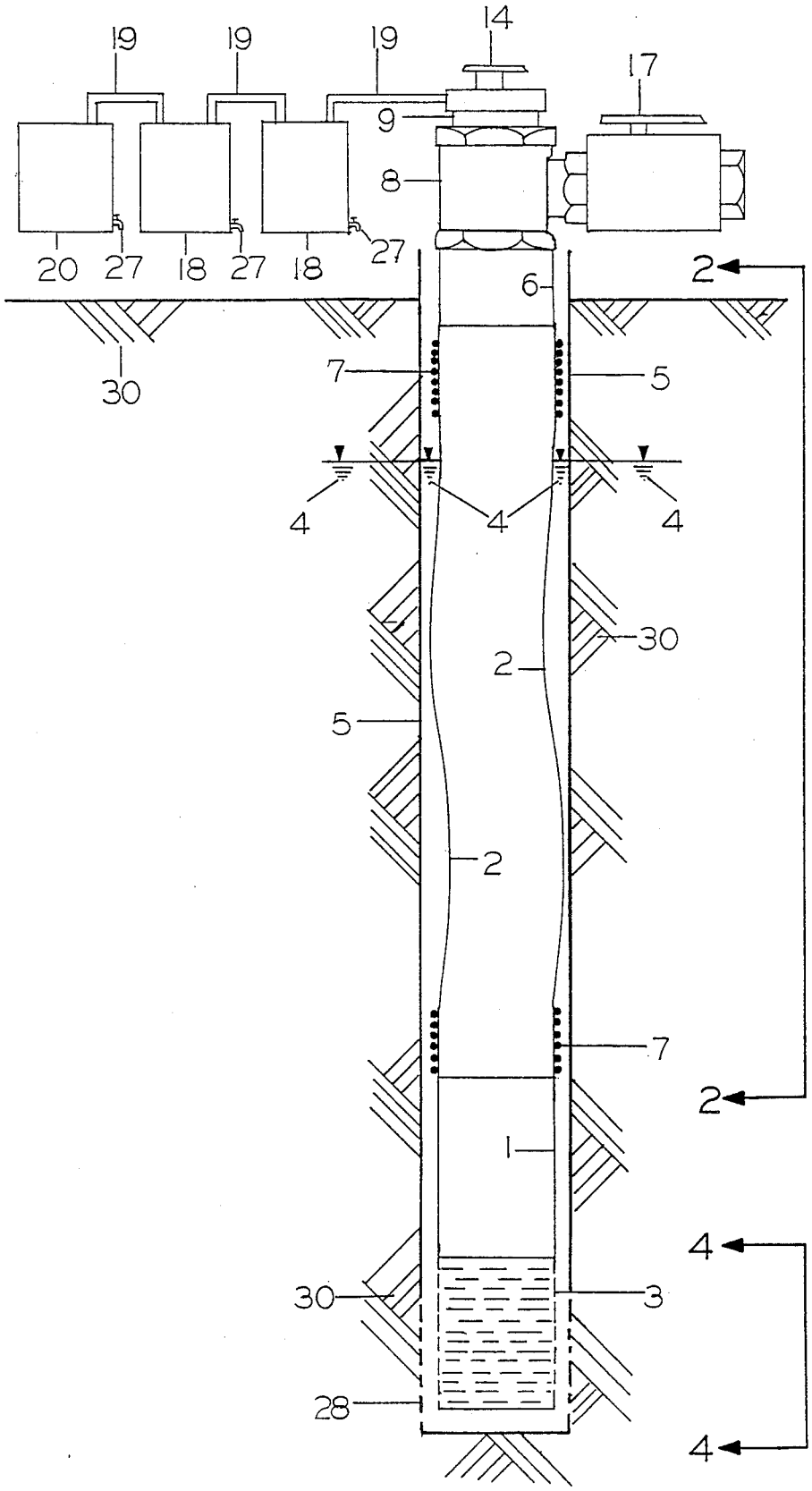
FIG. 1 is a general view of the pumping system inside a monitoring well indicating relative positions of the component parts with the bladder type outer hose of the coaxial hose not inflated.

In the drawings which illustrate the pumping system of the present invention, the same reference numerals have been used to refer to similar details throughout the several views.

Figure 2:
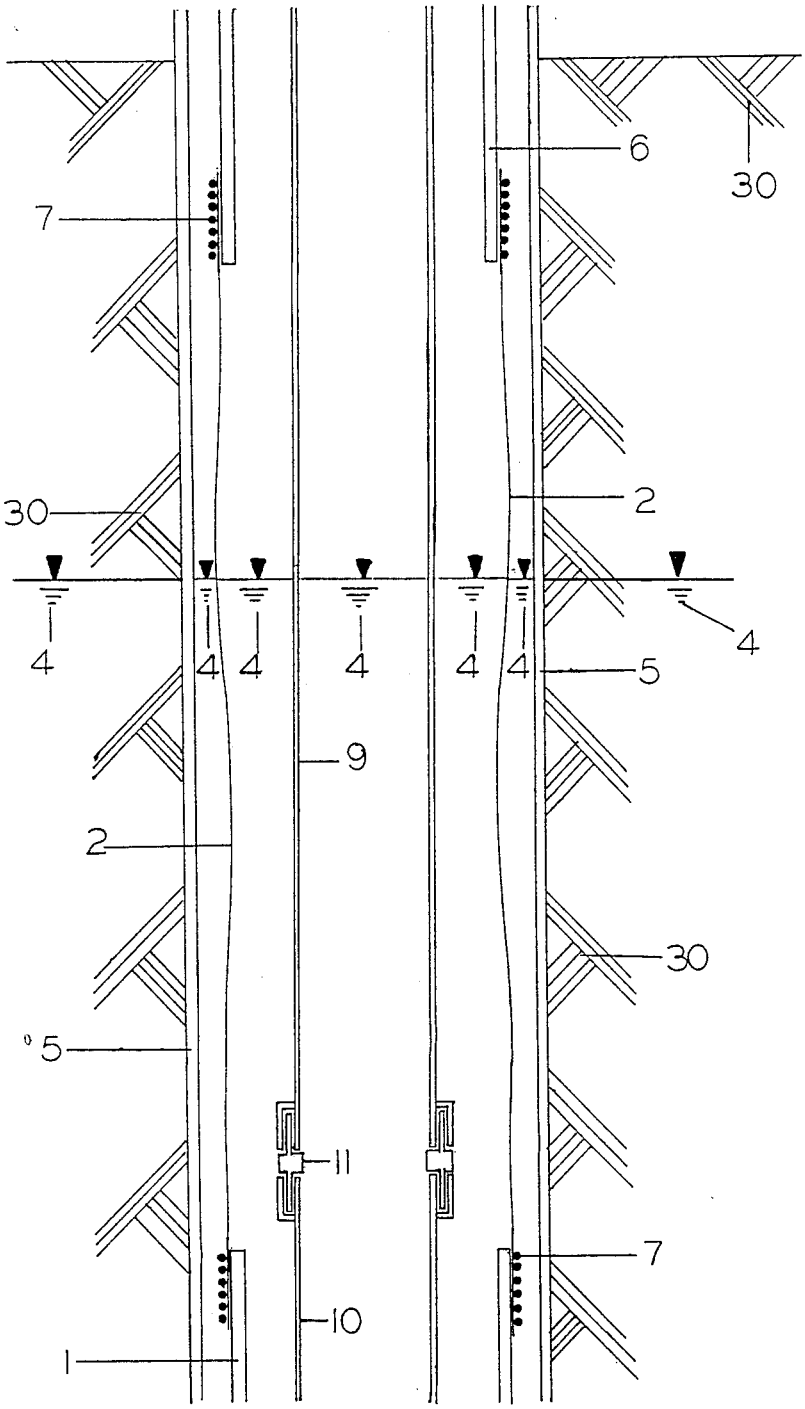
FIG. 2 is a partial sectional view, taken along line 2—2 of FIG. 1, showing the relative connections of the coaxial hose to the pumping device, and the well fluids inside and outside the pumping system being at the same level. The bladder type outer hose is shown not inflated in FIG. 2.
Figure 3:
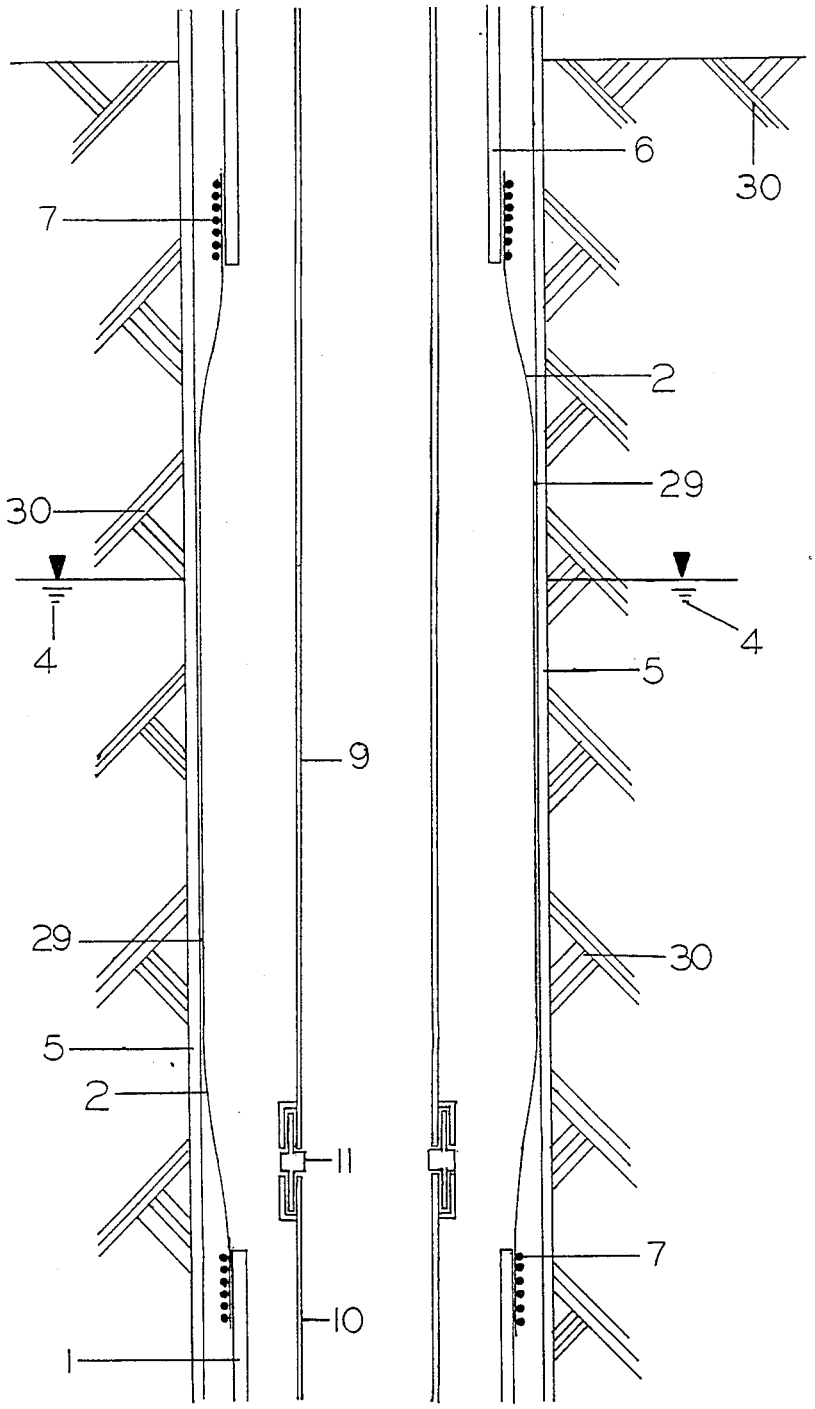
FIG. 3 is a partial sectional view, like FIG. 2, after the pumping system was connected to a power fluid source, and the bladder type outer hose of the coaxial hose was inflated to engage the inner surface of the well casing thus forming a seal, and after all well fluids have been evacuated.
Figure 6:
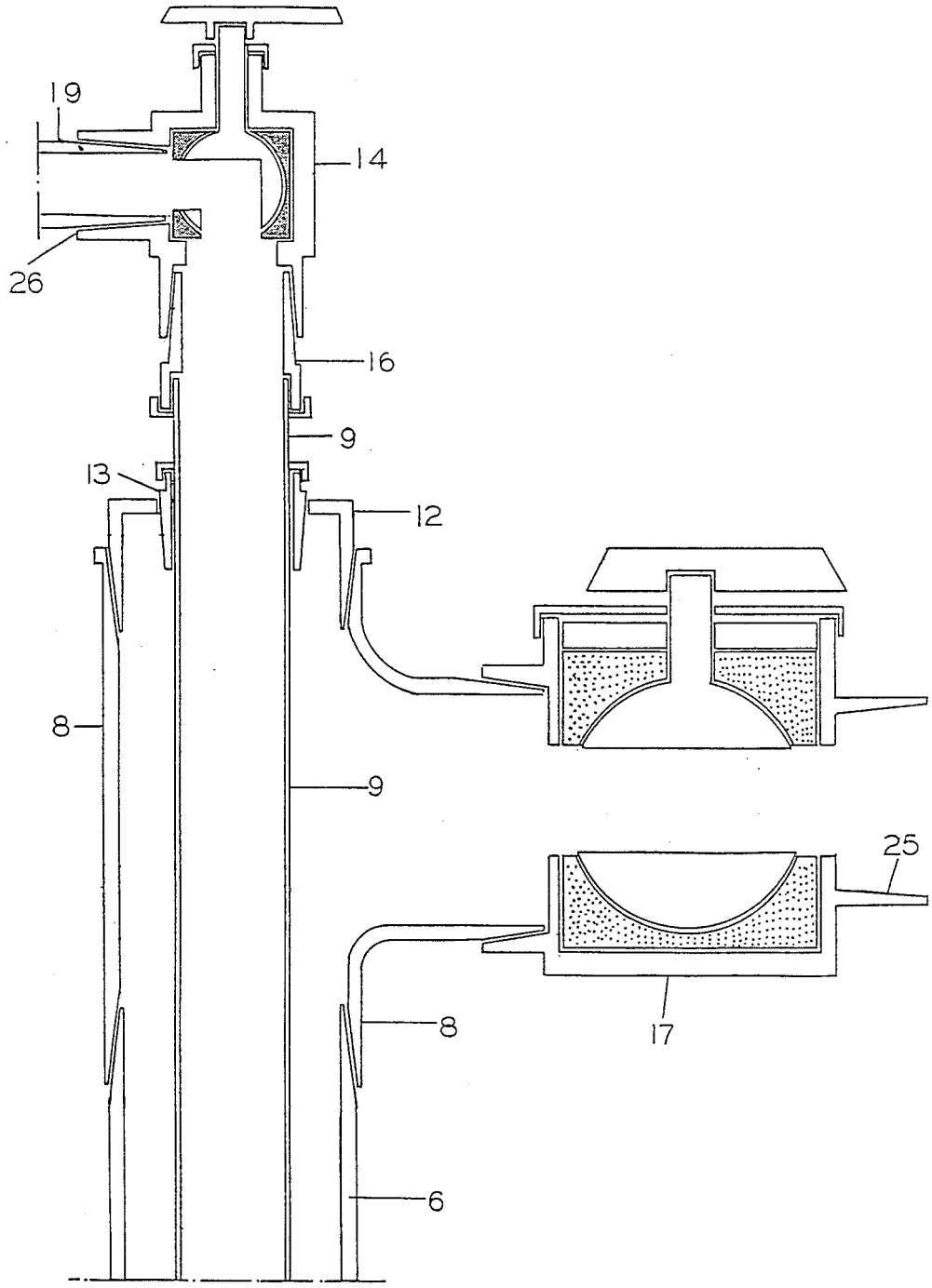
FIG. 6 is a sectional view, taken along line 613 6 of FIG. 5, showing the connections of the outer bladder type hose, and the inner tubing of the coaxial hose relative to the coaxial hose splitter.
Figure 7:
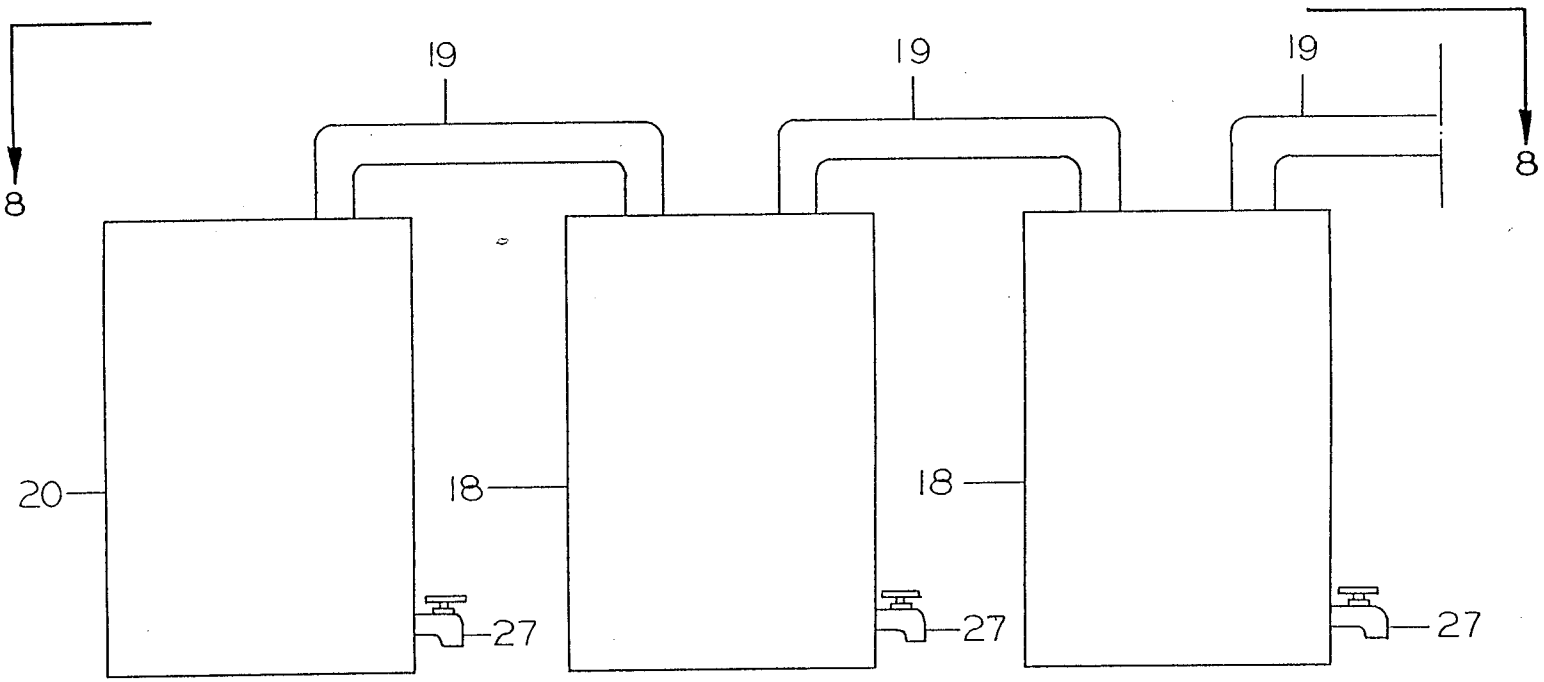
FIG. 7 is an elevation view of the separators and the respective connections.
Figure 8:
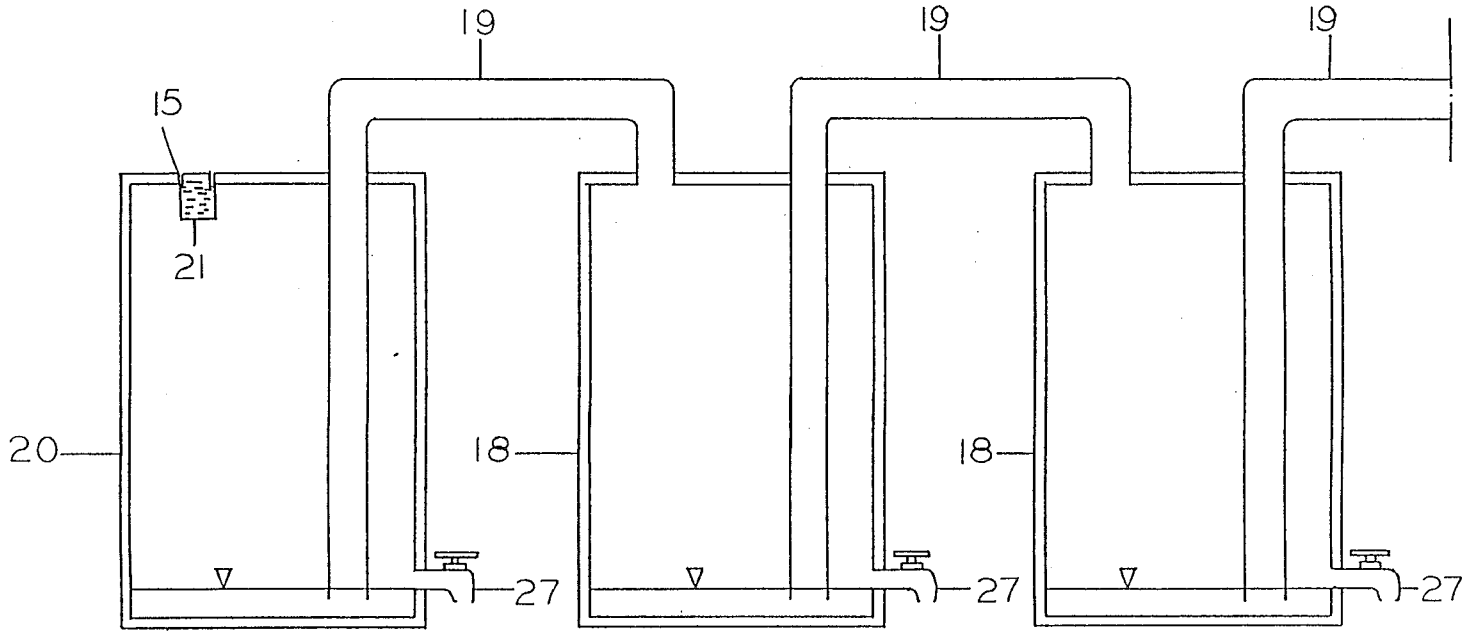
FIG. 8 is a sectional view taken along line 8—8 of FIG. 7.

The pumping system comprising a fluid actuated pumping device 1, with its well fluids filtering screen 3, and the coaxial hose 2 submerged in the (influent) stagnant well fluids 4, inside the monitoring well casing 5, is shown in FIG. 1. The outer hose 2 of the coaxial hose, best shown in FIG. 2, is a bladder type hose made of a material inert to the well fluids. The outer hose 2 is sealingly attached to the outer tube 1 of the pumping device, and to the pipe nipple 6, by any suitable means such as by clamping action using multiple wounds of stainless steel wire 7 as shown in FIG. 2. pipe nipple 6 is sealingly connected to the bottom end of the tee pipe fitting 8 by any suitable means such as threads as shown in FIG. 6. The inner tubing 9 of the coaxial hose is a relatively rigid tubing which may be connected to the inner tube 10 of the pumping device, and to the top end of the tee pipe fitting 8 of the coaxial hose splitter, by any suitable means such as tubing to tubing connector 11, and a reducer 12 and tubing to pipe connector 13 respectively, as shown in FIG. 2, and FIG. 6. The inner tubing 9 of the coaxial hose exits at the top end of the tee pipe fitting 8 of the coaxial hose splitter, and it is connected to the discharge control valve 14 with any suitable means such as tubing to pipe fitting 16, as shown in FIG. 6. The power fluids supply control valve 17 is connected to the side end of the tee pipe fitting 8 of the coaxial hose splitter as shown in FIG. 6, by any suitable means such as threads. The function of the coaxial hose splitter will become more apparent below in the description of the operation of the pumping system. The well fluids, carried by the power fluids, are separated from the power fluids by any suitable means such as by passing the discharge stream through one or more separators 18 connected in series by any suitable means, such as pipes 19 as shown in FIG. 7 and FIG. 8. The last of such separators 20 has an opening 15 and may be exhausting through a filter 21 to the atmosphere as shown on FIG. 8.

A controlled supply of power fluids, such as pressurized air, is connected to the inlet 25 of the power fluids supply control valve 17, and the outlet 26 of the discharge control valve 14 is connected to the separator 18 by any suitable means such as pipe 19, as shown on FIG. 6. Each separator 18 and 20 has at its side and close to its bottom a drainage valve 27, as shown in FIG. 8.

Figure 4:
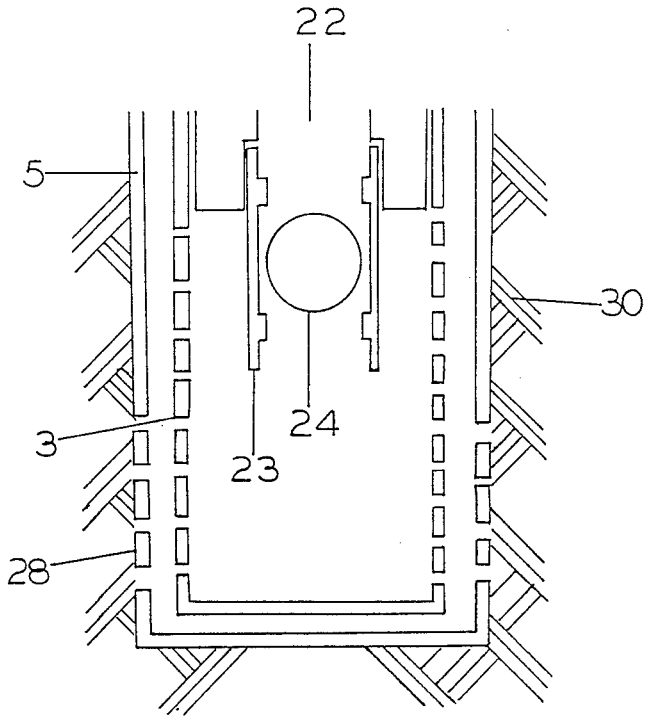
FIG. 4 is a partial sectional view taken along line 4—4 of FIG. 1, showing the inlet at the lower end of the pumping device and the attached one way ball check valve.
Figure 5:
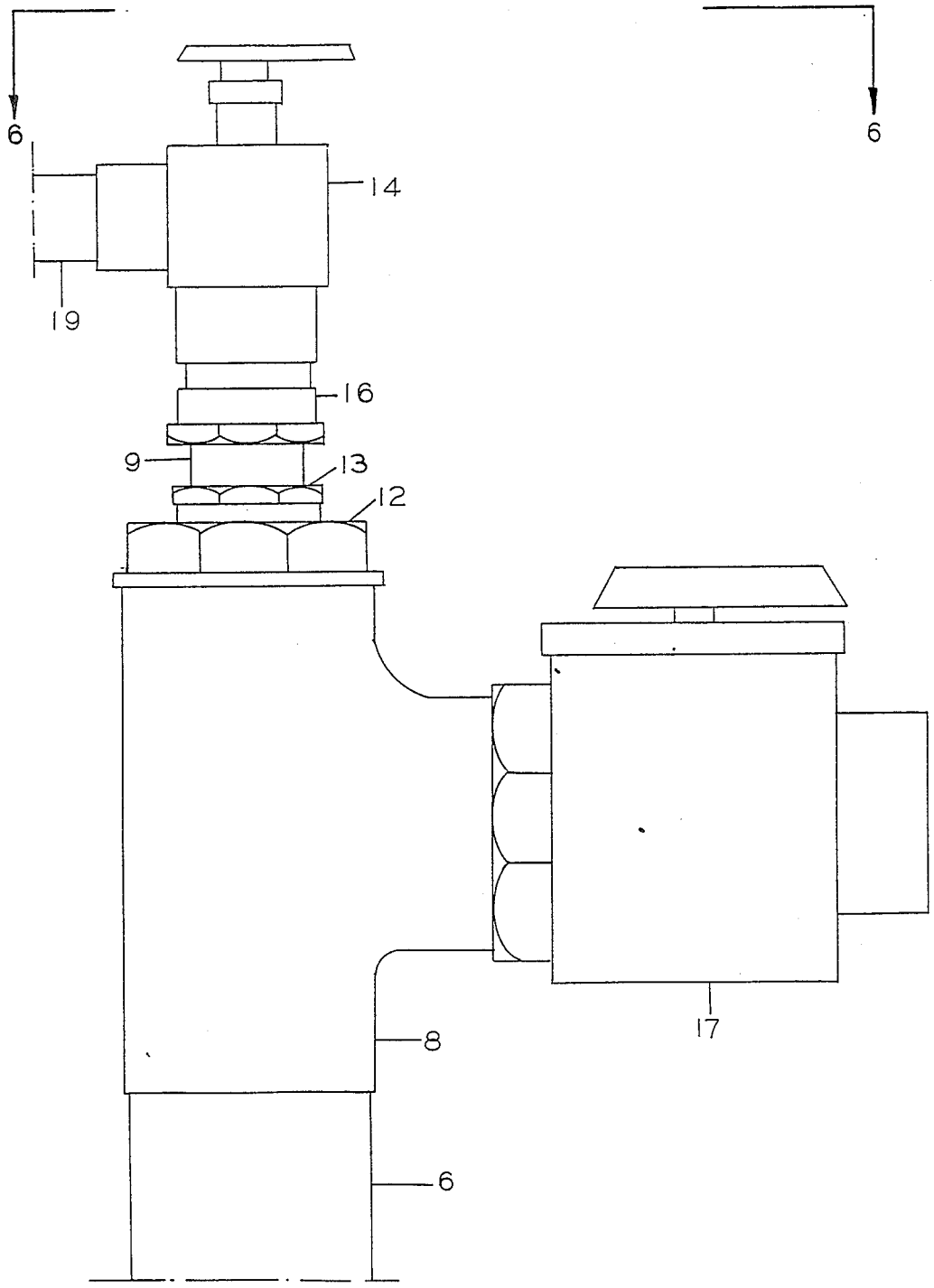
FIG. 5 is an elevation view of the coaxial hose splitter including the power fluids supply, and the discharge control valves.

At the inlet 22 of the pumping device a ball check valve 23, which may be of stainless steel with teflon ball 24, is mounted by any suitable means such as threads as shown in FIG. 4. The well fluids filtering screen 3, which may be of stainless steel, may be selected so that it will filter the well fluids free of solid particles of up to a certain size.

As the pumping system is lowered into the well and submerged bellow the well fuids 4, well fluids 4 enter through the one way ball check valve 23 into the pumping device and the coaxial hose, and occupy all the available space inside and outside the pumping system below the level of the well fluids in the well, as shown in FIG. 1 and FIG. 2. After the pumping system is installed at the desired depth in the well, and a source of power fluids such as pressurized air is connected to the inlet 25 of the power fluids supply control valve 17, pressurized air is supplied in the annular space between the outer hose 2 and the inner tubing 9 of the coaxial hose. Due to the supplied presurized air, at least the following three pumping functions are performed simultaneously by the pumping system: Firstly, the upper section of the bladder type outer hose 2 close to the well head is inflated against the inner surface of the well casing 5, and progressively the inflation propagates downward to the entire length of the outer hose 2; secondly, all well fluids inside the pumping device and the coaxial hose are evacuated through the inner tubing 9 of the coaxial hose, and are lifted to the ground surface; and thirdly, as pressurized fluids flow through the pumping device during and after evacuation of well fluids from inside the pumping system, suction is created at the inlet 22 of the pumping device as described in the copending application Ser. No. 07/311,086, filed Feb. 15, 1989, and U.S. Pat. No. 4,832,577.

The downward progressive inflation of the outer hose 2 of the coaxial hose against the inner surface of the well casing 5, results in a simultaneous downward progressive formation of seal 29 at the contact between the inner surface of the well casing 5, and the outer hose of the coaxial hose 2. As the aformentioned seal 29 is formed and propagates downwardly, well fluids 4, between the outer hose 2 of the coaxial hose and the well casing 5, are pressurized and flow downwardly toward the pumping device. There, under pressure a major portion of these well fluids enters through the well fluids filtering screen 3 into the pumping device via the one way ball check valve 23, and only a minor portion may be forced through the well screen 28 into the geologic formation, as shown in FIG. 4. The intrusion of the aformentioned major portion of well fluids under pressure into the pumping device during operation, is further enhanced by the suction of the pumping device which is simultaneously created while the well fluids inside the pumping device and the coaxial hose are evacuated, or while pressurized air is flown through the pumping device. Due to the formation of seal 29 at the contact between the outer hose 2 and the well casing 5, the suction created by the pumping device in the well space below seal 29, is transmitted through well screen 28 into the geologic formation, and actively extracts fluids from the pores of the geologic formation. Under such active suction conditions, the minor portion of the well fluids that had been forced to flow into the formation during inflation of the outer hose 2 of the coaxial hose, is quickly extracted, followed by active extraction of additional formation fluids. Regardless of the hydrogeologic characteristics of the formation, the time needed to recapture the minor portion of the well fluids that forced into the formation, does not exceed the time that these fluids were under pressure. Therefore, with the pumping system of the present invention, the time necessary to evacuate entirely the first volume of stagnant well fluids from the well, including the minor portion of well fluids that may have been forced into the formation during initial pressurization, does not exceed twice the time needed to evacuate the well fluids inside the pumping device and the coaxial hose. This time estimate is valid even under the most conservative conditions which assume that the ball check valve 23 remained closed during evacuation of the well fluids from inside the pumping device and the coaxial hose, and opens only after pressurized air flows through the pumping system. Even under such coservative conditions, the time needed for the pumping system of the present invention to evacuate one volume of well fluids entirely, is by far less than the respective time needed by most devices of the existing art.

The pumping system disclosed herein may also be used to develop (enhance the yelding capacity of) a well. Development of a well is possible by removing fine soil particles from the well screen. Fine soil particles are removed by the flushing action of well fluids flowing in and out of the well screen. Such flushing action is induced to the well fluids by the pumping system during the initial pressurization step of the continuous operation mode, or during each inflation-deflation cycle of the intermitent operation mode.

To operate the pumping system of the present invention the following operation steps may be executed.

1. Establish all appropriate connections prior to submerging of the pumping system into the well fluids.

2. Open the power fluids supply control valve 17, and the discharge control valve 14, and submerge the pumping system to the desired depth into the well fluids.

3. Close the power fluid supply control valve 17, connect the pumping system to a power fluid (pressurized air) source, mark the time, and commence pumping by opening the power fluids supply control valve 17, and pumping well fluids to ground surface. Outer hose 2 of the coaxial hose inflates in response to the pressurized air, and engages the well casing forming thus a seal, progressively from the well head downward.

4. Wait until the first surge of well fluids to ground surface passes through the pumping system, as noted by the beginning of a continuous flow of mostly air out of the discharge control valve 14, and mark the time again. The time interval between the times recorded in steps 3 and 4 is approximately equal to the time that well fluids outside the pumping device may had been under pressure, and may had been forced into the geologic formation during pressurization. The time marked in step 4 also denotes approximately the time a which the pumping system starts actively to extract, by suction, fluids from the pores of the geologic formation. To extract entirely the first volume of well fluids, allow the pumping system to operate beyond the time recorded in step 4, for an additional time interval equal to the time interval between the times recorded in steps 3 and 4.

5. Cease operation of the pupming system by closing the power fluids supply contol valve 17.

6. For an active extraction of fluids (gases or liquids) from the pores of a geologic formation, and pumping of such fluids to the ground surface, the pumping system may operate continuously provided the power fluids control valve 17 remained opened in step 3. For pumping of well fluids to the well head, after the pumping system was submerged into the well fluids, the pumping system may operate intermitently by repeating steps 3, 4, and 5.

7. For well development, the pumping system of the present invention may be used by alternatively opening and closing the power fluids control valve 17, to create several surge action cycles without pumping well fluids to ground surface. Such surging action cycles will free fine soil particles from the well screen, and when ocassionally followed by steps 3, 4, and 5 will pump well fluids containing the already freed soil particles to the ground surface, developing thus the well.

The intermitent operation of the pumping system of this disclosure may be automated using a controller device. One type of such controller device is disclosed in U.S. Pat. Nos. 4,489,779 and 4,585,060.

Operating the pumping system of the present invention in the continuous suction mode, only the inlet of the check valve 23 at the bottom of the pumping device must come in contact with the free surface of the well fluids. It is not necessary for the pumping system of this disclosure operating in the continous suction mode to be lowered below the free surface of the well fluids as is necessary with devices of the prior art, such as bailers or positive displacement bladder pumps. Further, operating the pumping device disclosed herein to extract by suction fluids from the pores of a geologic formation, as is often required in cases of petroleum product spills in soils, the extraction well is not required to be built above the ground water table as it is required for fluid extraction schemes of the prior art. This is an important advantage of the disclosed system over the systems of the prior art. With the pumping system disclosed herein, existing monitoring wells with their screens entirely below ground water table may be used as efficient gas and/or liquid extraction wells, resulting thus in large cost savings. This is possible because the pumping system disclosed herein, may pump fluids of the gaseous and/or liquidus phases simultaneously. Consequently, this latter pumping system may be installed in existing monitoring wells that may have screens entirely below the ground water table. Then, firstly operate intermitently or continuously thus lowering the free surface of the liquid phase to a level below the top of the well screen; and secondly operate continuously to extract, by suction through the well screen of the monitoring well, pore fluids directly from the pores of the geologic formation above the lowered ground water table.

Having thus described the preferred form of the pumping system, it will be understood that this invention may be in forms other than that described as being the preferred and without departing from the scope of the invention as defined in the appended claims.

What is claimed is:

1. A well pumping system for use in an elongate well, said pumping system comprising: A rigid and elongate inner casing in fluid communication with the well for discharging well and pressurized fluids; a flexible and elongate outer casing disposed around said inner casing; an elongate opening disposed between said inner and outer casings, in fluid communication with said well, for receiving well and pressurized fluids; pumping means for pumping well fluids, such pumping means being in fluid communication with said well, said elongate opening and the opening through said inner casing; said outer casing deforming outwardly in response to said pressurized fluids, to force the well fluids outside said outer casing to move longitudinally of said outer casing towards said pumping means, and to engage the walls of the well to form a seal; said well fluids in said elongate opening forced longitudinally of said outer casing towards said pumping means in response to the pressurized fluids; said pumping means receives fluids from said well and said elongate opening, and discharges said fluids through the opening of said inner casing to the ground surface.

2. The well pumping system of claim 1, wherein said pumping means is a pressurized fluid activated pumping means.

3. The well pumping system of claim 1 wherein said pumping means is disposed between said seal provided by said outer casing and the bottom of said well.

4. The pumping system of claim 3 further comprising filtering means for filtering said well fluids; said filtering means disposed at the inlet of said pumping means.

5. The well pumping system of claim 4 further comprising separator means for separating said well fluids from the well fluids-pressurized fluids mixture; said separator means include a plurality of tanks containing well fluids retaining means: said plurality of tanks being in fluid communication with said inner casing; said plurality of tanks include means for directing said well fluids-pressurized fluids mixture through said well fluids retaining means.

6. The well pumping system of claim 1 wherein said inner and outer casings are coaxial.

* * * * *